US010609795B2

(12) United States Patent
Kumar et al.

(10) Patent No.: US 10,609,795 B2
(45) Date of Patent: Mar. 31, 2020

(54) FAULT DETECTION SYSTEM

(71) Applicant: SIGNIFY HOLDING B.V., Eindhoven (NL)

(72) Inventors: Rohit Kumar, Hackensack, NJ (US); Maulin Dahyabhai Patel, Tuckahoe, NY (US)

(73) Assignee: SIGNIFY HOLDING B.V., Eindhoven (NL)

( * ) Notice: Subject to any disclaimer, the term of this patent is extended or adjusted under 35 U.S.C. 154(b) by 431 days.

(21) Appl. No.: 15/505,128

(22) PCT Filed: Jul. 27, 2015

(86) PCT No.: PCT/IB2015/055668
§ 371 (c)(1),
(2) Date: Feb. 20, 2017

(87) PCT Pub. No.: WO2016/027181
PCT Pub. Date: Feb. 25, 2016

(65) Prior Publication Data

US 2019/0159325 A1 May 23, 2019

Related U.S. Application Data

(60) Provisional application No. 62/038,862, filed on Aug. 19, 2014.

(51) Int. Cl.
*H05B 37/02* (2006.01)
*H05B 37/03* (2006.01)

(52) U.S. Cl.
CPC ..... *H05B 37/034* (2013.01); *H05B 37/0272* (2013.01)

(58) Field of Classification Search
CPC ..... H05B 37/0272; H05B 37/034
USPC ..... 315/291, 307, 308
See application file for complete search history.

(56) References Cited

U.S. PATENT DOCUMENTS

| | | | | |
|---|---|---|---|---|
| 2009/0066258 | A1 | 3/2009 | Cleland et al. | |
| 2013/0029682 | A1 | 1/2013 | Ganick et al. | |
| 2013/0057158 | A1* | 3/2013 | Josefowicz | G01S 19/14 315/152 |
| 2013/0183042 | A1* | 7/2013 | Knapp | G08C 23/04 398/106 |

(Continued)

FOREIGN PATENT DOCUMENTS

| | | | |
|---|---|---|---|
| CN | 101738539 | A | 6/2010 |
| EP | 2503856 | A2 | 9/2012 |

(Continued)

*Primary Examiner* — Dedei K Hammond
*Assistant Examiner* — Amy X Yang
(74) *Attorney, Agent, or Firm* — Meenakshy Chakravorty

(57) ABSTRACT

A fault detection system (100) for detecting faulty devices among a first plurality of serviceable devices (200) is provided. The serviceable devices have a wireless transmitter (210) arranged to periodically transmit a wireless signal (230) that encodes a device identifier. Mobile devices have a receiver (310) arranged to receive the wireless signal of a serviceable device within the transmission range, and to obtain the device identifier from the wireless signal. A fault detector (400) is arranged to detect faulty devices by selecting device identifiers in the plurality of device identifiers for which no device identifier was received in a time period.

13 Claims, 10 Drawing Sheets

(56) References Cited

U.S. PATENT DOCUMENTS

| | | | | |
|---|---|---|---|---|
| 2013/0193876 | A1 | 8/2013 | Cleland et al. | |
| 2013/0257284 | A1* | 10/2013 | VanWagoner ..... | H05B 37/0245 315/131 |
| 2014/0018111 | A1 | 1/2014 | Farley et al. | |
| 2014/0028200 | A1 | 1/2014 | Van Wagoner et al. | |

FOREIGN PATENT DOCUMENTS

| | | | |
|---|---|---|---|
| GB | 2392326 | A | 2/2004 |
| JP | 2005100764 | A | 4/2005 |
| JP | 2010086686 | A | 4/2010 |
| WO | 2007033053 | A2 | 3/2007 |
| WO | 2010116289 | A1 | 10/2010 |
| WO | 2013/054221 | A1 | 4/2013 |

* cited by examiner

420

| 421 | 422 |
|---|---|
| 1899 | X |
| 2055 | X |
| 6921 | - |
| 7851 | X |
| 7490 | X |
| 8753 | - |
| 9774 | X |
| 7268 | X |
| 8452 | - |
| 9306 | X |

Fig. 2a

420'

| 421 | 423 | 424 |
|---|---|---|
| 1899 | 1406789304 | 0.08:25:30 |
| 2055 | 1406774258 | 0.12:36:16 |
| 6921 | 1406597792 | 2.13:37:22 |
| 7851 | 1406786344 | 0.09:14:50 |
| 7490 | 1406774854 | 0.12:26:20 |
| 8753 | 1406718740 | 1.04:01:34 |
| 9774 | 1406795475 | 0.06:42:39 |
| 7268 | 1406733517 | 0.23:55:17 |
| 8452 | 1406235838 | 6.18:09:56 |
| 9306 | 1406748140 | 0.19:51:34 |

Fig. 2b

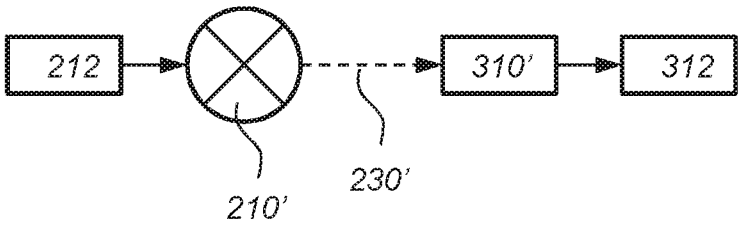
Fig. 3a
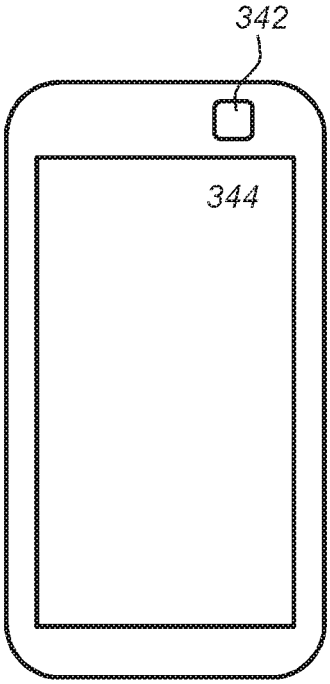
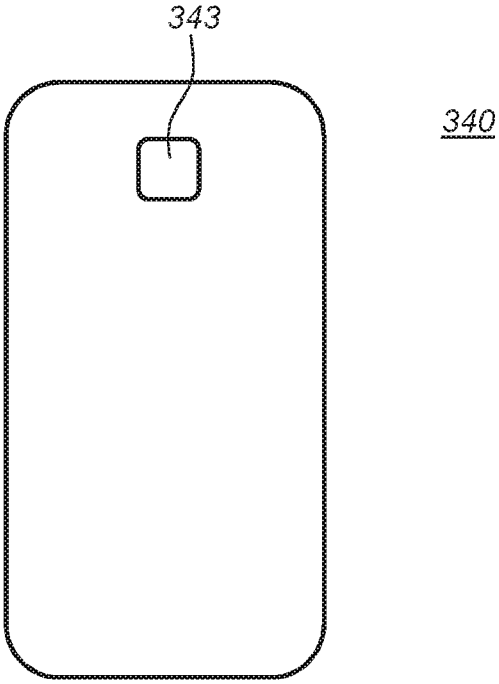
Fig. 3b
Fig. 3c

FAULT DETECTION SYSTEM

CROSS-REFERENCE TO PRIOR APPLICATIONS

This application is the U.S. National Phase application under 35 U.S.C. § 371 of International Application No. PCT/IB2015/055668, filed on Jul. 27, 2015, which claims the benefit of U.S. Patent Application No. 62/038,862, filed on Aug. 19, 2014. These applications are hereby incorporated by reference herein.

FIELD OF THE INVENTION

The invention relates to a fault detection system, a mobile device, a fault detector, a fault detection method, a computer program, and a computer readable medium.

BACKGROUND

In the business of lifecycle services maintenance, support and performance services are provided to a customer for an extended period of time. For example, servicing of luminaires is an important business. The health of a luminaire is important information needed to provide such timely services. This information could be collected easily in case of networked system.

For example, a known system is described in International patent application WO2007033053 A2, with title "Light management system having networked intelligent luminaire managers, and applications thereof", included herein by reference.

The known system comprises luminaires that have an intelligent luminaire manager. The intelligent luminaire manager is configured to transmit status information for the associated luminaire. The status information includes at least an indication of a lamp-out condition upon occurrence of a lamp out condition. The known system also comprises a network server that receives the status information from intelligent luminaire managers.

At the network server one can obtain a list of all luminaires that need servicing. Unfortunately, this solution requires computer network capability at the luminaire, which is expensive and often not available. Therefore there is a need for a low-cost solution to gather information regarding the health of a luminaire.

The situation is aggravated for LED lamps, which may have a lifetime of about 50000 hours. If they are used for on an average 8 hours per day then they will last about 17 years. Nevertheless, also LED fixtures may fail, e.g., due to failure of electronics, power system components, lighting strikes, mechanical stresses etc. Even though failure rate of LED lamps is much lower, without network capability in the LED lamp, conventional verification of the lamps may still be needed; For example, sending maintenance personnel to do "drive-by" visual examination of all units, which is expensive. The latter is especially unfortunate, since due to the low failure rate of the lamps, this servicing becomes an even larger part of the costs of the system.

For maintenance one may also rely on customer notification. For example, a subway user may report that a particular lamp in a particular station does not work. Unfortunately, customer reports are often too infrequent to rely on for a high level of maintenance.

SUMMARY OF THE INVENTION

A fault detection system for detecting faulty devices among a first plurality of serviceable devices is provided as in Claim 1. The first plurality of serviceable devices is distributed across a geographic area.

The system comprises the first plurality of serviceable devices, a second plurality of mobile devices and a fault detector.

Serviceable devices of the first plurality of serviceable devices comprise a wireless transmitter arranged to periodically transmit a wireless signal, the wireless signal being receivable in a transmission range surrounding the serviceable device, the wireless signal encoding information, the information comprising at least a device identifier corresponding to the serviceable device uniquely identifying the serviceable device within the first plurality of serviceable devices.

Mobile devices of the second plurality of mobile devices comprise:

- a receiver arranged to receive the wireless signal of a serviceable device within the transmission range, and to obtain the device identifier from the wireless signal, and
- a local storage unit for storing a list of received device identifiers, the receiver being arranged to add a device identifier received by the receiver to the list,
- a computer network sender arranged to send the list of device identifiers to a fault detector.

The fault detector is arranged to detect faulty devices, the fault detector comprises

- a computer network receiver arranged to receive multiple lists from multiple mobile devices of the second plurality of mobile devices.
- a database storing a plurality of device identifiers of the first plurality of serviceable devices,
- a fault detection unit arranged select device identifiers in the plurality of device identifiers for which no device identifier was received in a time period.

The system is well suited for luminaires as the serviceable devices. In the latter case, the wireless signal may still be a radio signal, but may also be the light of the luminaire itself.

In an embodiment, serviceable devices of the first plurality of serviceable devices comprise a light source, the light source being arranged for illuminating a surrounding area of the light source, the wireless signal being light emitted by the light source modulated by the wireless transmitter to encode the information, the receiver of the mobile devices of the second plurality of mobile devices comprises a camera arranged to receive said modulated light. The modulated light may be visible light, e.g., visible for a human observer.

In the fault detection system the serviceable device need not be networked. Mobile devices report to the fault detector the device identifiers that they happened to come across. The fault detector determines the identifiers that have not been reported for some time, and conclude that the corresponding serviceable device may have a problem. Interestingly, even in case of a full break down of the device, e.g. complete loss of power, this may still be detected by the fault detector. In a networked device this would not be possible, as the network connection may be affected by the break-down.

The fault detection system may be used both for indoor and outdoor environments. Furthermore, detection of light-out conditions may be more accurate than techniques based on sensors. For example, a photo sensor may be included in a luminaire to verify that the luminaire is operating correctly. However, photo sensors will not differentiate between the illumination due to the luminaire or to, say, an incoming car, daylight, etc. The differentiation is possible in the system as the stray light does not encode a device identifier.

The mobile device may use a so-called crowdsourcing technique. Crowdsourcing can be defined as the practice of obtaining needed services, information, etc. by soliciting contributions from a large group of people. When a participating mobile device equipped with a camera is in range of the luminaire, it receives the code and processes it to identify the health of the luminaire. A large amount of data may be collected through crowdsourcing and helps to improve the confidence of results and eliminate dependence on individuals.

The serviceable devices, mobile devices, and fault locator are electronic devices. The serviceable devices may be luminaires; the mobile devices may be mobile phones, tablets, and the like.

A method according to the invention may be implemented on a computer as a computer implemented method, or in dedicated hardware, or in a combination of both. Executable code for a method according to the invention may be stored on a computer program product. Examples of computer program products include memory devices, optical storage devices, integrated circuits, servers, online software, etc. Preferably, the computer program product comprises non-transitory program code means stored on a computer readable medium for performing a method according to the invention when said program product is executed on a computer.

In a preferred embodiment, the computer program comprises computer program code means adapted to perform all the steps of a method according to the invention when the computer program is run on a computer. Preferably, the computer program is embodied on a computer readable medium.

Thus a fault detection system for detecting faulty devices among a first plurality of serviceable devices is provided. The serviceable devices have a wireless transmitter arranged to periodically transmit a wireless signal that encodes a device identifier. Mobile devices have a receiver arranged to receive the wireless signal of a serviceable device within the transmission range, and to obtain the device identifier from the wireless signal. A fault detector is arranged to detect faulty devices by matching device identifiers received by the mobile devices with a database, selecting device identifiers in the plurality of device identifiers for which no device identifier was received in a time period.

BRIEF DESCRIPTION OF THE DRAWINGS

These and other aspects of the invention are apparent from and will be elucidated with reference to the embodiments described hereinafter. In the drawings, FIG. 2*a* shows a schematic representation of a database according to an embodiment, FIG. 2*b* shows a schematic representation of a database according to an embodiment, FIG. 3*a* shows a schematic representation of a detail of a fault detection system according to an embodiment, FIG. 3*b* shows a schematic front view of a mobile device according to an embodiment, FIG. 3*c* shows a schematic back view of a mobile device according to an embodiment.

Figure 1:
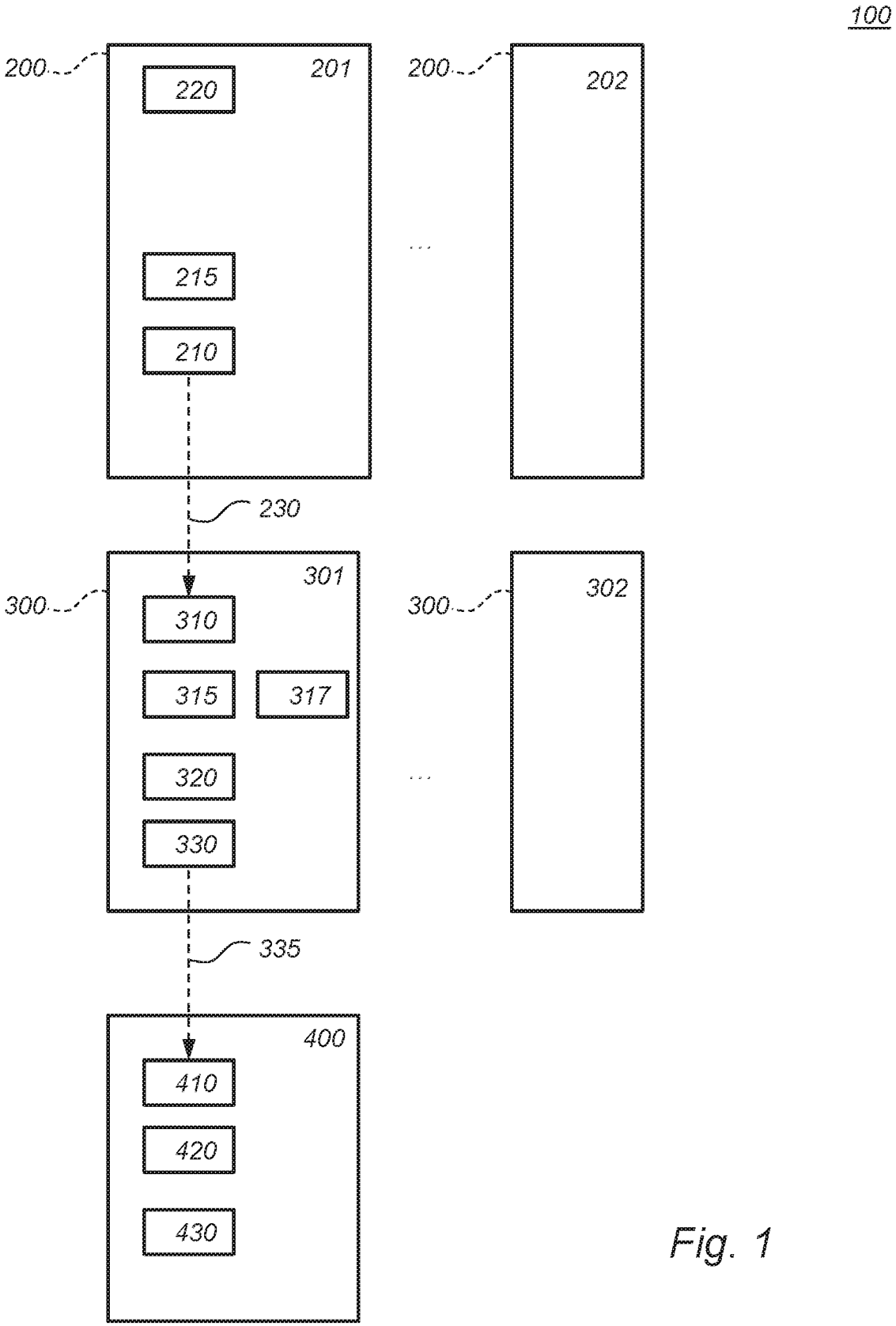
FIG. 1 shows a schematic representation of a fault detection system according to an embodiment.

Items which have the same reference numbers in different figures, have the same structural features and the same functions, or are the same signals. Where the function and/or structure of such an item has been explained, there is no necessity for repeated explanation thereof in the detailed description.

LIST OF REFERENCE NUMERALS IN FIGS. 1-5*b*

100 a fault detection system
101 a fault detection system
200 a first plurality of serviceable devices
201, 202 a serviceable device
210 a wireless transmitter
210' a light source
212 a modulator
215 a transmitter controller
220 an identifier memory
222 a health indicator unit
230 a wireless signal
230' coded light
300 a second plurality of mobile devices
301, 302 a mobile device
310 a receiver
310' a camera
311 a sampling frequency controller
312 a demodulator
315 an information obtainer
317 a clock
320 a local storage
330 a computer network sender
335 a computer network message
340 a mobile phone
342 a front camera
343 a back camera
344 a screen
350 an identifier store
351 a set identifier
352 a set of identifiers
352' a set of serviceable devices
353 a compression unit
360 a path
361 an area
370 a scheduler
400 a fault detector
410 a computer network receiver
420, 420' a database
421 device identifiers
422 arrival indicators
423 device identifier timestamps
424 delay (days.hours:minutes:seconds)
430 a fault detection unit

500 a floor
501, 503, 504 a room
502 a hallway

DETAILED DESCRIPTION OF EMBODIMENTS

While this invention is susceptible of embodiment in many different forms, there is shown in the drawings and will herein be described in detail one or more specific embodiments, with the understanding that the present disclosure is to be considered as exemplary of the principles of the invention and not intended to limit the invention to the specific embodiments shown and described.

In the following, for sake of understanding, the system is described in operation. However, it will be apparent that the respective elements are arranged to perform the functions being described as performed by them.

FIG. 1 shows a schematic representation of a fault detection system 100 according to an embodiment. Fault detection system 100 omits many possible refinements and presents a relatively straightforward implementation.

Fault detection system 100 is arranged to detect faulty devices among a first plurality 200 of serviceable devices. The system comprises first plurality 200, a second plurality 300 of mobile devices and a fault detector 400.

Out of first plurality 200, two serviceable devices are shown: serviceable device 201 and serviceable device 202. Membership to the plurality 200 has been illustrated as a dashed line. The system may comprise many more serviceable devices than the two shown. In an embodiment, the number of serviceable devices is larger than 1000, larger than 100000, or even larger than a million serviceable devices.

A serviceable device is an electric device that requires occasional servicing, in particular manual servicing by maintenance personal. The fault detection system is particular well suited for detecting faults in electric lights. Electric lights are serviceable devices as they may require a replacement of the light source, e.g., after it has burnt out. The system is even better suited for detecting faults in electric LED lights, including OLED.

There is a need to detect quickly if a serviceable device needs servicing, e.g., repair, replacement, etc. This could be accomplished by providing each serviceable device with a long range information sender, e.g., a computer network sender. However, providing serviceable devices with, say, Wi-Fi units, is not economical. It is a problem, how to detect the serviceable device from among a plurality of such devices, if they are not capable of directly communicating to a central location.

First plurality 200 of serviceable devices is distributed across some geographic area. There are many possible choices for the geographic area. For example, the geographic area may be indoors; say, an office, a floor of an office building, or multiple office floors, a hospital, multiple buildings, etc. For example, the geographic area may be outdoors; say a park, a city, a highway, etc. The geographic area may also combine indoor and outdoor locations, say, and a university campus, including indoor and outdoor serviceable devices.

In an embodiment, first plurality 200 of serviceable devices are outdoor and/or indoor luminaires. For example, first plurality 200 may be lights in one or more stations of a subway, e.g. underground electric railway. The number of serviceable devices in a large city may run in the hundreds of thousands.

Devices of the first plurality of serviceable devices are arranged with a device identifier corresponding to the serviceable device uniquely identifying the serviceable device within the first plurality of serviceable devices. For example, serviceable device 201, which represents a typical device of first plurality 200, comprises an identifier memory 220. Identifier memory may be a digital, electronic memory. For example, Identifier memory 220 may be a non-volatile, electronic memory, for example a flash memory.

The device identifier may be stored in some type of programmable read-only memory, e.g., a programmable read-only memory (PROM), a field programmable read-only memory (FPROM) or one-time programmable non-volatile memory (OTP NVM). In this case the device identifier is permanent and cannot be changed after an initial programming of the device identifier in the serviceable device.

The device identifier may be programmed into the serviceable device some time after or during manufacture. The device identifier may be programmed during operation; For example, a serviceable device, e.g., a luminaire, may comprise an Ethernet-over-power receiver to receive a device identifier. An Ethernet-over-power receiver does not imply that the serviceable device may also send messages.

Devices of the first plurality of serviceable devices may each comprise a wireless transmitter. For example, serviceable device 201 comprises wireless transmitter 210. Wireless transmitter 210 is arranged to periodically transmit, e.g. broadcast, a wireless signal 230 that is receivable in a transmission range surrounding serviceable device 201. The wireless signal encodes information. The information comprises at least the device identifier corresponding to the serviceable device.

Thus when the wireless signal is received it identifies the serviceable device, as the device identifier uniquely identifies the serviceable device. Moreover, correct reception of the signal gives at least some indication that the serviceable device is in working order. If the serviceable device were broken to a point, say, that it is no longer under power, it would not have been capable of transmitting the wireless signal.

In an embodiment, the wireless signal may be a radio signal, and the wireless transmitter may be a radio signal transmitter; for example, the wireless signal may be an RF signal, and the like. For example, the radio signal may be modulated to encode the information.

The wireless signal may be a so-called coded light signal. The term coded light is generally used to refer to the light output of lighting systems that have a dual function; i.e. lighting systems that provide an illumination function and a communication function, by allowing the modulation of data on the light output in a manner that is substantially imperceptible to end users. The fault detection system is well suited to encoding information in the light of a luminaire. In an embodiment, serviceable devices of the first plurality of serviceable devices comprise a light source. The wireless signal is light emitted by the light source modulated by the wireless transmitter to encode the information. At the same time, the light source may illuminate a surrounding area of the light source. Note that in this embodiment, reception of the wireless signal gives an even stronger indication that the serviceable device is in working order, that is, reception of coded light indicates that the light source is working.

Serviceable device 201 may further comprise a transmitter controller 215 arranged to schedule the periodic transmission of the information. For example, the information may be transmitted once every second; the transmission may be more or less often.

The other devices of the first plurality 200 may use the same basic design as device 201. Nevertheless, the system can support a wide range of serviceable devices. In particular, in an embodiment, the first plurality 200 comprises many different luminaires. In an embodiment, all devices of the plurality 200 comprise a wireless transmitter arranged to periodically transmit a wireless signal, the wireless signal being receivable in a transmission range surrounding the serviceable device, the wireless signal encoding information, the information comprising at least a device identifier corresponding to the serviceable device uniquely identifying the serviceable device within the first plurality of serviceable devices.

The geographic area may contain further devices, serviceable or not, that do not participate in the system, and which are not part of the first plurality 200; this is no problem.

System 100 further comprises a second plurality 300 of mobile devices. FIG. 1 shows two mobile devices of second plurality 300: mobile device 301 and mobile device 302. Membership to the plurality 300 has been illustrated as a dashed line. System 100 supports many mobile devices in the second plurality. These may range from a few devices, to large numbers, say, more than a 1000, more than 100000, or even more than a million mobile devices.

Devices of second plurality 300 may be mobile phones, tablets, laptops, and the like. Like first plurality 200, not all devices of second plurality 300 need to be identical. System 100 supports a great variety of devices.

Mobile devices of the second plurality of mobile devices comprise a receiver, a local storage unit, and a computer network sender. Mobile device 301 represents a typical mobile device of second plurality 300.

Mobile device 301 comprises a receiver arranged to receive wireless signal 230 of a serviceable device of first plurality 200, say of serviceable device 201, if mobile device 301 is within the transmission range. For example, if device 201 is configured to transmit a radio signal, then mobile device 201 comprises a radio signal receiver, say a Wi-Fi receiver. For example, if the wireless signal is coded light, then the receiver may be a camera.

The receiver is also configured to obtain the device identifier from the wireless signal. Thus, in case mobile device 301 is within range of serviceable device 201, the mobile device can obtain the device identifier stored in memory 220, through the wireless signal 230.

For example, mobile device 301 may demodulate wireless signal 230 to obtain the information encoded therein. For example, receiver 310 may use an information obtainer 315 to obtain the information from wireless signal 230. For example, information obtainer 315 may be a demodulator.

Mobile device 301 comprises a local storage unit 320 for storing a list of received device identifiers. Receiver 310 is arranged to add the device identifier received by the receiver to the list. Mobile device 301 comprises a local storage to store the list of received device identifiers.

Note that mobile device 301 typically cannot know if a serviceable device is broken or not. A broken device is typically not capable of sending wireless signal 230, thus the mobile device is not even informed of the presence of the serviceable device, let alone, its status. Furthermore, there may be many reasons why a mobile device may not receive a device identifier, e.g., the device may be turned off, the device may be out of range; in case coded light is used, the line-of sight between a camera of the mobile device and the light may be obstructed etc. On the other hand, mobile device 301 is capable of detecting a working device, e.g., by detecting wireless signal. Moreover, by obtaining the device identifier in the wireless signal, mobile device 301 can also detect which serviceable device is working.

It will be clear to those skilled in the art of coded light system design that instead of using a camera, which is present on most smart-phones and thus provides a very favorable embodiment for crowd-sourcing, it may also be possible to use other light sensing means, such as one or more photodiodes. Such photodiodes may be integrated in the mobile devices, or may be provided as an add-on to mobile devices, such as mobile phones and/or tablets. Photodiodes may for example provide light sensing functionality, in that one or more photo-diodes with suitable optics may be coupled to a circuit that can be connected to a 3.5 mm audio jack suitable for use with the mobile phone microphone input, thereby re-purposing the microphone input on the mobile device for coded light detection.

Mobile device 301 comprises a computer network sender 330 arranged to send the list of device identifiers to a fault detector 400. For example, the computer network sender 330 may be a Wi-Fi unit. Computer network sender 330 may use any one of GPRS, UMTS, LTE, etc. Sending the list of device identifiers and/or other information to the fault detector using the computer network sender will also be referred to as uploading. Mobile device 301 may delete the list after it has sent the list of fault detector 400.

During operation, a mobile device of the second plurality 300, say mobile device 301, may be located in the geographic area in which the serviceable devices of first plurality 200 are located; for example, mobile device 301 may travel through the area.

During that time, mobile device 301 may come near enough to only a small portion of the serviceable device for reception to be possible. If the mobile device 301 is near enough to a serviceable device, then mobile device 310 may receive its device identifier; There is no guarantee though that this will happen. Thus after a time period, say a day, any given mobile device, say mobile device 301 will store in its local storage a list containing only a small percentage of all working serviceable devices. An individual mobile device cannot draw any conclusion as to which serviceable devices are working or not.

Fault detector 400 is arranged to detect faulty devices.

Fault detector 400 comprises a computer network receiver 410 arranged to receive multiple lists from multiple mobile devices of the second plurality of mobile devices. For example, receiver 410 may receive a list from mobile device 301, and a list from mobile device 302, etc. The computer network is typically the internet, although other computer network could be used, say a corporate LAN. Fault detector 400 may be implemented as a server, in which case computer network receiver 410 may provide a network connection for the server.

Fault detector 400 comprises a database 420 storing a plurality of device identifiers corresponding to the first plurality of serviceable devices. For each device of the first plurality of serviceable device, its unique device identifier is stored in the database. Together with the device identifier additional information may be stored, in particular the location of the serviceable device that corresponds to the device identifier. Such information enables maintenance personal, to attend to the serviceable device, should it be identified as likely faulty. Location information may take a number of forms; they may be coordinates, they may be area identifiers, say room numbers, etc.

Fault detector 400 comprises a fault detection unit 430 arranged to match received device identifiers with the device identifier stored in the database. Fault detection unit 430 selects device identifiers from the plurality of device identifiers in the database for which no device identifier was received in a time period.

During operation, participating mobile devices receive device identifiers from working serviceable devices. Each individual mobile device may see only a small part of all the serviceable devices in the first plurality. However, together the mobile devices in the second devices will see a larger part of the first plurality, preferably all of the first plurality. Thus fault detection unit 430 may deduce from the absence of a device identifier, e.g., a device identifier not reported as seen in the time period by any mobile device, that the corresponding serviceable device is likely broken and needs servicing.

Instead of setting the threshold at zero, i.e. no device identifier reported, fault detection unit 430 may set the threshold to a higher number, say less than 10 reports. The latter may avoid false positives caused by, e.g., incorrectly received device identifiers.

The time period may depend on the application. For example, how long broken and unattended devices are acceptable. A high time period will reduce false positives (reporting a serviceable device as broken, even though it works correctly) as it is more likely that some mobile device will have seen the serviceable device in the time period. A low time period will reduce false negatives (not reporting a serviceable device as broken, even though it is broken).

The cost of a false positive or false negative may differ depending on the application, and thus an acceptable value of the time period may differ for an application. For example, sending a service person to a device may be costly, but broken lights especially in prominent places may also be costly, e.g., as loss of goodwill.

As a guideline, as the number of serviceable devices in the first plurality grows the time period may be set larger, as the number of mobile device in the second plurality grows the time period may be set smaller. For example, the time period may be set to 7 days, and increased or decreased depending on reports of false positive and negatives.

FIG. 2*a* shows a schematic representation of a database 420 according to an embodiment. Database 420 may be used by fault detector 400. Database 420 may also be used by some of the embodiments explained with reference to FIG. 4*a*, below.

Database 420 shows device identifiers 421. In this illustration, 10 device identifiers are shown, each being a four digit number. In practice, the database may comprise more device identifiers. A device identifier may be a binary number, say a 16 bit, or a 32 bit number, etc.

Together with device identifiers, database 420 may also store arrival indicators 422. An arrival indicator, indicates if the device identifier has been reported by any mobile device of the second plurality in the past time period.

Figure 4A:
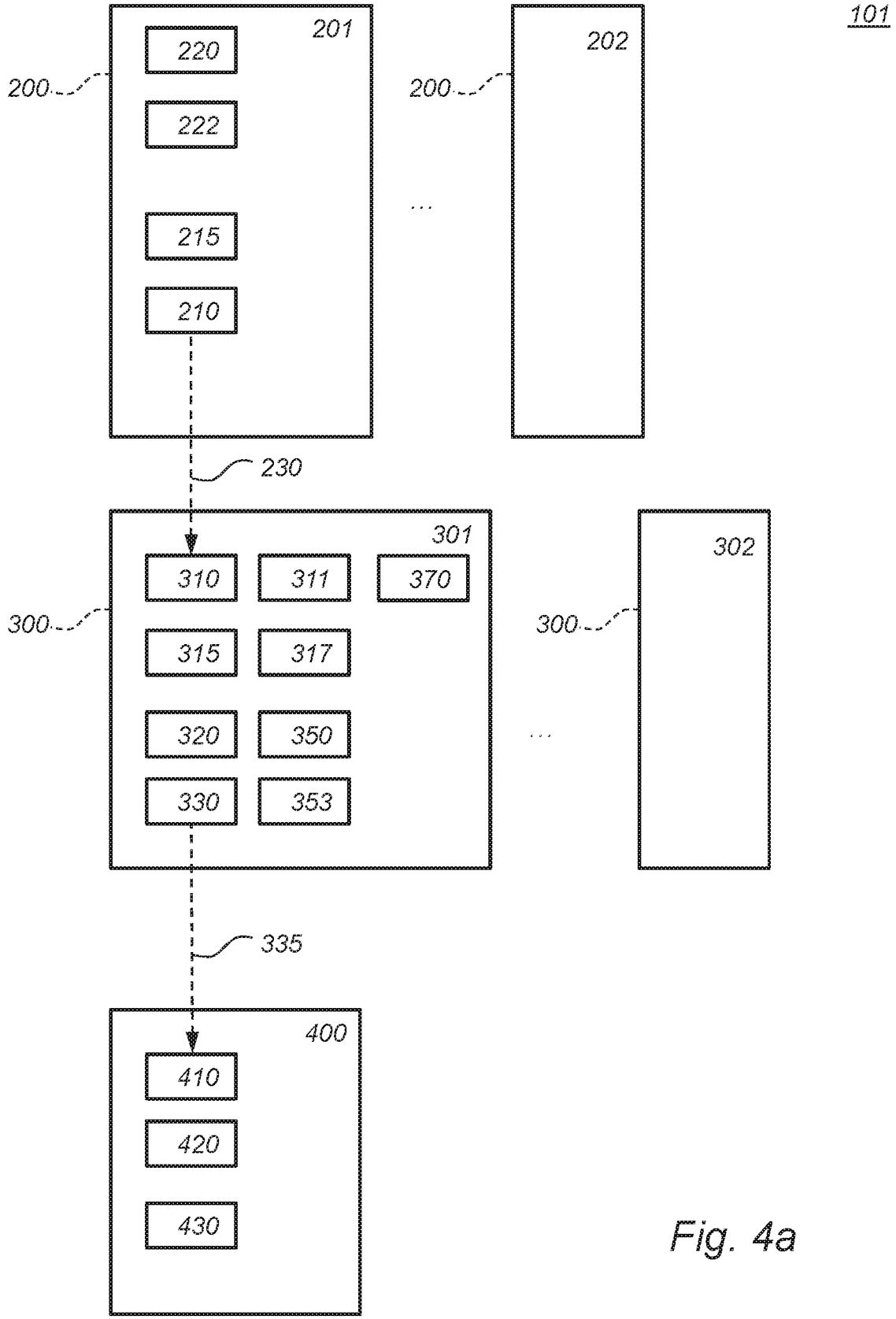
FIG. 4*a* shows a schematic representation of a fault detection system according to an embodiment.

For example, the time period may be a day. For example, at the start of the time period, say at the start of the day, the arrival indicators may be reset. As device identifiers are reported in lists received by the fault detector from the mobile devices, corresponding arrival indicators are set. In FIG. 4*a*, a set arrival indicator is represented as an 'X'. The time period may be set to different values, say a week.

For example, in an embodiment, the fault detection unit is arranged to set an arrival indicator for each device identifier for each list received from mobile devices.

Using database 420, the fault detection unit may estimate which serviceable devices likely needs service. For example, this may be done at the end of the time period. In the illustration shown in FIG. 2*a*, device identifiers 6921, 8753, and 8452 were not set. This means that none of the participating mobile devices received these identifiers and reported them to the fault detector. Likely, especially with a well chosen time period, this is because these devices were defective.

FIG. 2*b* shows a schematic representation of a database 420' according to an embodiment. Database 420' may be employed in an embodiment in which mobile devices comprise a clock, and report device identifiers together with a time stamp. For example, such an embodiment may use a mobile device 301 that comprises a clock 317 arranged to add a time stamp to the device identifier, indicating when the device identifier was received, and to store the device identifier in the list together with the timestamp.

Database 420' comprises a list of identifiers 421, like database 420. Database 420' comprises a list of device identifier timestamps 423. For example, the time stamp may be the latest (latest in time) reported time stamp for that device identifier.

For example, in an embodiment, fault detection unit 420 is arranged to look-up a current timestamp in the database for a device identifier in a received list, and to compare the current timestamp with a received timestamp in the received list corresponding to the device identifier; in case the received timestamp is later in time fault detection unit 420 replaces the current timestamp with the received timestamp in the database for the device identifier. Fault detection unit may perform this action for each received list and for each device identifier thereon.

Fault detection unit may use database 420' to select serviceable devices that are likely faulty. For example, Fault detection unit may select all serviceable devices for which the current time minus the recorded timestamp is over a threshold.

In illustration 2*b*, timestamps 423 are represented in the UNIX timestamp format, e.g., 32 bit numbers that represent the number of elapsed seconds since 1 Jan. 1970. Consider the serviceable device with device identifier 1899; it has a current timestamp of 1406789304. Should a list be received at fault detector 400, which contains this device identifier, (in this example 1899), with a timestamp below 1406789304, the database is not updated for this device identifier; but if the timestamp in the received list were higher, the data base would be updated to the higher number.

In an embodiment, mobile device 301 adds an upload timestamp to the list that represents the moment of uploading, according to clock 317. Fault detector 400 may correct received timestamps by adding to timestamps in a received list a correction value; the correction value equals the difference between the moment of receiving the list according to a clock of fault detector 400 minus the upload timestamp.

Fault detection unit 430 may use database 420' to compute a delay representing the amount of time since the last timestamp for a serviceable device was received. For example, the difference with the current time, say 1406819634 in the mentioned UNIX format. For device identifier 1899, the difference is 1406819634−1406789304=30330 seconds. FIG. 2*b* shows the result of these computations for all shown device identifiers, under heading 424. For clarity the results are shown in day.hours:minutes:seconds format; any suitable time format may however be used.

Fault detection unit 430 can use the delay to select serviceable devices for which the latest timestamp is longer ago than the time period. If the time period is a day, then devices 6921, 8753, 8452 would be selected as they show a delay 424 larger than the time period. Database 420' may be used at any point, not just at the end of a time period. Moreover, no resets are needed for arrival indicators for database 420'.

Use of database 420' requires clocks in the mobile devices. The latter may be avoided. For example, a mobile device may simply add device identifiers to the list, without a timestamp. Fault detector 400 may use the moment of arrival as the timestamp. To avoid pollution by old lists that are uploaded, fault detector 400 may do the following. For all mobile devices in the second plurality the last time moment a list was uploaded is stored, say in a further database. If the time difference between the previous uploaded list and the current uploaded list is higher than a threshold, say 3 days, then the fault detector 400 may discard the information in the list. For example, fault detector 400 may be configured to, when a mobile device uploads a first list, to store a first time moment, e.g. a timestamp, together with an identifier of the mobile device, say, a mac address, a cookie, etc., and, when the mobile device later uploads a consecutive second list, to look up the first time moment based on the identifier of the mobile device, and to determine a difference between a current time, e.g., the moment of uploading, and the first time moment is determined.

FIG. 3*a* shows a schematic representation of a detail of a fault detection system according to an embodiment.

Serviceable device 201 comprises a light source 210' as the wireless transmitter. The light source has a double function: it transmits the wireless signal and it also illuminates an area surrounding the light source. For example, the light source may light an indoor location or an outdoor location, say an office, a park, etc. Device 201 comprises a modulator 212 to encode the information, in particular the device identifier, in the light. In this embodiment, coded light 230' is produced as the wireless signal. Mobile phone 301 may comprise a camera 310' as the receiver and a demodulator 312 to recover the information, in particular the device identifier, from the coded light. The light source may be any light source that may be modulated fast enough to encode information without the human observers noticing the modulation, e.g., LED light sources.

FIG. 3*b* shows a schematic front view of a mobile device 340 according to an embodiment.

FIG. 3*c* shows a schematic back view of a mobile device 340 according to an embodiment.

Mobile phone 340 comprises a front camera 342, a back camera 343. Mobile phone may optionally comprise a screen 344, say a touch screen. Mobile phone 340 may comprise only a single camera. The camera's function as a receiver arranged to receive the modulated light from the light source.

The mobile phone may store a software program, e.g. a so-called 'app' that performs a receiving function, obtaining the device identifier, and possibly other information, from a received camera image, e.g. received by front or back camera 342 and 343. The software program may perform a storing function, storing a list of received device identifiers. The software may perform a sending function, sending the list of device identifiers to a fault detector, say fault detector 400.

Interestingly, the operation of the software program may be in the background. Images that are received on a camera are analyzed for device identifiers. The user of the mobile phone need not be aware of this. Multiple device identifiers may be obtained from a single camera simultaneously; for example, if multiple light sources of serviceable devices are in view of the camera at the same time.

Encoding information in the light of light sources is known per se; see e.g. United States patent application US2013/0029682 A1, in particular FIGS. 1-5, with title "Method and system for tracking and analyzing data obtained using a light based positioning system", incorporated by reference.

FIG. 4*a* shows a schematic representation of a fault detection system 101 according to an embodiment. System 101 includes several optional refinements; these refinements may individually be omitted from system 101, or separately included in system 100.

Serviceable device 201 comprises an optional health indicator unit 222. The health indicator indicates the health of the serviceable device, e.g., in the form of a health indicator. The health indicator is digital information, e.g., a set of digital values that indicate whether the serviceable device is operating within correct operating parameters. The operating parameters are chosen so that operating outside the correct ranges of these one or more operating parameters may point to a failure of the device.

The wireless transmitter of at least part of the serviceable devices of the first plurality of serviceable devices, say serviceable device 201, may be arranged to include the health indicator in the information.

In case health indicators are used the mobile devices, say mobile device 301, are configured to obtain the health indicator from the wireless signal, and to store it in the local storage, e.g., together with the device identifier and a timestamp (if the latter is used). When the mobile phone uploads its list to fault detector 400, the health indicators that are received are included. To reduce data, the mobile device or the serviceable device may omit health indicators in the upload or the wireless signal if the operating parameters are within correct ranges.

If health indicators are used, then fault detection unit 400 may be arranged to detect faulty devices from received health indicators. For example, fault detection unit 400 may select serviceable devices for which an operating parameter is furthest out of normal operating range. The health indicator may also be used together with a delay. For example, for a device with a health indicator for which an operating parameter out of normal operating range was detected, a shorter delay time is allowed before servicing. For example, for a normal device a delay of 2 days may used, e.g., servicing is ordered after 2 days of not seeing the device identifier, but if the latest health indicator was bad, then only 1 day of not seeing the device identifier is needed before the fault indicating unit selects the serviceable device for servicing.

There are a number of operating parameters that were found to predict a failing LED lamp.

In an embodiment, a serviceable device comprises a current measurement unit arranged to measure current through the light source during operation, the health indicator depending on the measured current.

In an embodiment, a serviceable device comprises a voltage measurement unit arranged to measure voltage over the light source during operation, the health indicator depending on the measured voltage.

In an embodiment, a serviceable device comprises a power factor unit arranged to determine the power factor of the light source during operation, the health indicator depending on the power factor. The power factor is a measure of how effectively the load takes power from the line, e.g., the power plant. For example, the power factor may be defined as real power consumed by a load (expressed in Watts) to apparent power (expressed in VA). A bad power factor may indicate various LED problems. For example, Power may be recycled from the LED light source; Harmonics from the LED light source or fixture are degrading the line and affecting the performance of other equipment on the line.

In an embodiment, a serviceable device comprises a temperature measurement unit arranged to measure the temperature of the light source during operation, the health indicator depending on the measured temperature. A temperature that is too high may indicate a malfunctioning heat sink, which in turn will lead to a burnt-out LED.

Reducing the amount of data stored by a mobile device in its local storage and/or uploaded to the fault detector is desirable. The fault detection system works better if many users participate, e.g., by downloading the app to a mobile device, such as a mobile phone. If the system uses too many resources, people may drop out. A number of data compression options have already been mentioned herein. Below a further compression option is discussed.

In an embodiment, mobile devices of the second plurality of mobile devices comprise an identifier store and a compression unit. For example, mobile device 301 may comprise an identifier store 350 and a compression unit 353.

Identifier store 350 stores a set of device identifiers. The set of identifiers comprises identifiers of serviceable devices of the plurality in a subarea of the geographic area. The device identifiers correspond to known serviceable devices; the set of identifiers is a different set than the list of device identifiers. One or more sets of device identifiers may be stored in a mobile device, for example, a set may be uploaded in the mobile device from the fault detector.

Figure 4B:
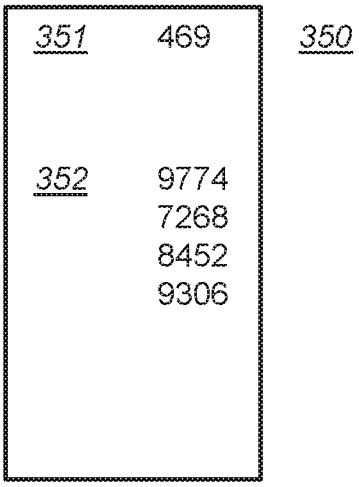
FIG. 4*b* shows a schematic representation of an identifier store according to an embodiment.

FIG. 4*b* shows a schematic representation of an identifier store 350 according to an embodiment. Identifier store 350 comprises a set of identifiers 352. Identifier store 350 may include additional information, e.g., a set identifier; the latter is particularly convenient if multiple sub-areas are used. In this illustration, set of identifiers 352 comprises four device identifiers, more or fewer device identifiers are possible.

Returning to FIG. 4*a*, compression unit 353 is arranged to determine if a number of device identifiers in the list of device identifiers which are not in the set of device identifiers is below a compression threshold; in other word words if the intersection between the list of device identifiers and the set of device identifiers is relatively large. For example, compression unit 353 may be arranged to verify for each device identifier in set 352, if the device identifier is stored in the list in the local storage, and thus, if that device identifier has been received using the wireless receiver. Ideally, compression unit 353 would conclude that all device identifiers in the set are in the list. However, compression unit 353 may also conclude that only a relatively small number of device identifiers in the set are absent from the list. The relatively small number, e.g., the compression threshold, may be set somewhere just under half the size of the set, say at 40% of the number of device identifiers in the set.

In the latter cases, it would be more efficient to send to the fault detector that device identifiers from the set that have not been received, instead of sending the device identifiers that have been received. Computer network sender 300 may be arranged to send device identifiers in the list absent from the set, in case of a positive determination of the compression unit.

In case of FIG. 4*b*: For example, computer network sender 300 may sent a message to fault detector 400 comprising: a compression indicator; indicating that this is a compressed report; a list of all devices in the set not in the list; the list may be empty. The compression system is well suited to a set of device identifiers that are closely located to each other, so that it is likely, that if a few of the corresponding serviceable devices have been seen, then they will all be seen.

A disadvantage of the compression system is that additional information may be not be transmitted. For example, no individual timestamps are sent. In an embodiment, compression unit 353 is arranged to compute an average timestamp for the device identifiers in the intersection of the set and the list. Compression unit 353 may be arranged to send the average timestamp together with the absent device identifiers. Instead of the average timestamp, also the latest, e.g. the smallest, timestamp may be used; or some other function of the timestamps of the intersection of the device identifiers in the set and the list.

Furthermore, in addition or alternatively, compression unit 353 may be configured to find all health indicators in the intersection of the device identifiers in the set and the list that are bad, e.g., outside normal operating ranges. Compression unit 353 may be arranged to send the device identifiers together with bad health indicators to fault detector 400, even though a device identifier is in the intersection of the device identifiers in the set and the list. Fault detection unit 400 is arranged to receive these compressed messages.

The fault detection system may be used in two modes. In a first mode, the mobile devices are arranged in a foreground mode. A user of the mobile phone would activate the system, say, start an app, and scan the surroundings, e.g., using the camera of the mobile device. The device identifiers that are scanned may be stored for later uploading to the fault detector 400. In a second mode, the mobile device operates in a background mode. If the user happens to use its mobile device, the mobile device uses the camera and records any device identifiers that happen to be in the viewfinder of a camera. The first and second mode may be combined. For example, the background may be used most of the time, but a user has the option to activate a foreground mode.

The fault detection system is well-suited to the background mode. In an embodiment, the receiver of mobile devices of the second plurality of mobile devices is arranged with a sampling frequency, the sampling frequency indicating the frequency of sampling a wireless signal received the receiver for a device identifier, the receiver being arranged to measure the time elapsed since adding a new device identifier not yet on the list, and to reduce the sampling frequency if the time elapsed exceeds a threshold.

For example, a mobile device, say mobile device 301, may comprise a sampling frequency controller 311. Sampling frequency controller 311 sets the sampling frequency with which a camera stream is checked for device identifiers. If no new device identifiers, e.g., device identifiers that are not yet on the list, have been seen since for some time, say longer than a threshold, the sampling frequency may be reduced. For example, a user may have the mobile phone in a position in which no useful images are received on the camera, or the user may be stationary in a position, and all local device identifiers have already been recorded by the system, etc. In these situations, the system may reduce the sampling frequency to preserve battery power. In an embodiment, the sampling frequency is increased when a device identifier is obtained from the camera that was not yet on the list.

In an embodiment, the mobile device is arranged to activate the information obtainer and/or the receiver to obtain device identifiers from the received wireless signal when the mobile device is woken from a sleep state to an active state. In an embodiment, the mobile device keeps the information obtainer and/or the receiver active for a maximum duration, say for 10 minutes. This limits battery usage without limiting received device identifiers too much, as most new device identifiers are received shortly after activating the mobile device.

The mobile device may also be configured to reduce or abort operation of the system if battery is low. Although this will impede seeing new device identifiers, it avoids depleting the battery. The latter may annoy the user, which is undesirable in a crowdsourcing application. Likewise, the mobile phone may delay uploading the received device identifiers until battery is above a threshold. The system is delay tolerant.

Figure 5A:
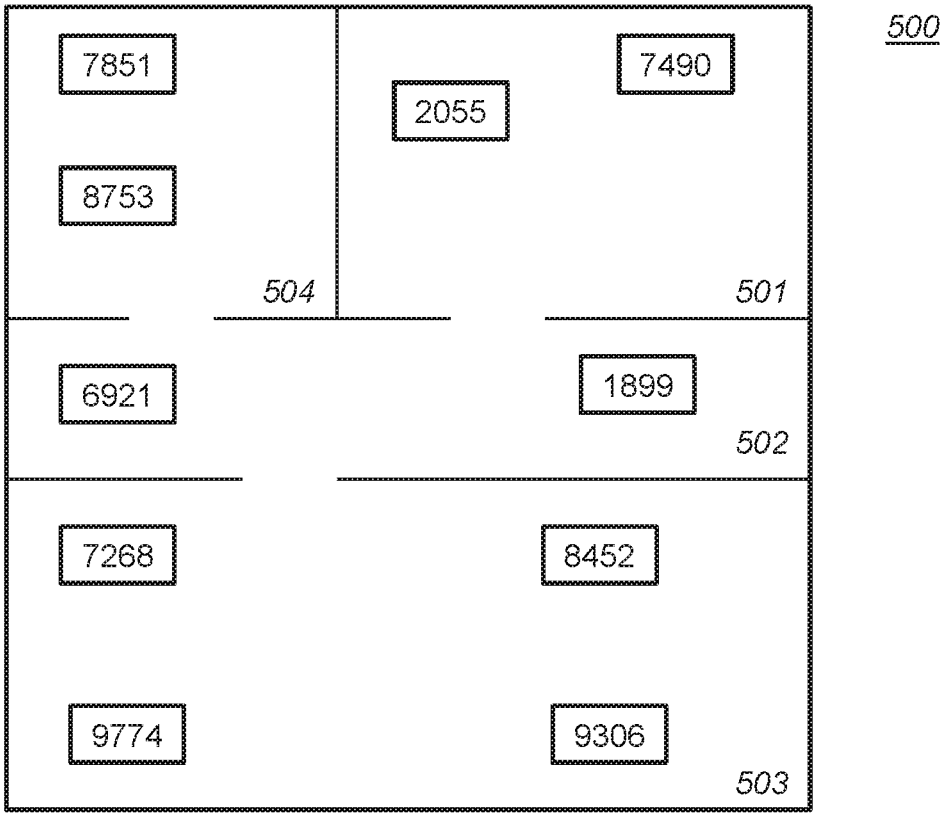
FIG. 5*a* shows a schematic representation of a geographic area according to an embodiment.

FIG. 5*a* shows a schematic representation of a geographic area according to an embodiment. In an example of an embodiment, the fault detection system is applied to an indoor lighting system. Shown is a floor 500. Floor 500 may be one of multiple floors. In the floor there are rooms and a hallway; shown are rooms 501, 503, and 504 and hallway 502.

In this embodiment, the serviceable devices are luminaires, e.g. lights; in this example, the same device identifiers are used as in FIGS. 2*a* and 2*b*. The mobile devices may include mobile phones.

Consider room 501. Two serviceable devices, 2055 and 7490, transmit their device identifier in a wireless signal; in this case by modulating the light that illuminates the room. Consider a user who uses his mobile device in room 501. The light of the device in the room are received by the camera of the mobile device. The device identifiers, 2055 and 7490 are obtained from the wireless signal by the mobile device and stored in a local storage, say a memory. Later, the mobile device sends the list of device identifiers to a fault detector using a computer network, say using the Internet.

The mobile device may be arranged with a time interval. When the mobile device receives a current device identifier that is already on the list, the current device identifier is added to the list together with a current time stamp, possibly replacing the copy that is already on the list, only if a time difference of the current time stamp and the timestamp that is already on the list exceed the time interval. The time interval may be set to, say, 1 hour.

Room 503 contains device identifiers that were used in the set of identifiers of FIG. 4*b*. If this compression is used for FIG. 5*a*, a mobile device that is in room 503, will likely see all device identifiers. Thus it is likely that the mobile device need only report a set identifier 351.

Figure 5B:
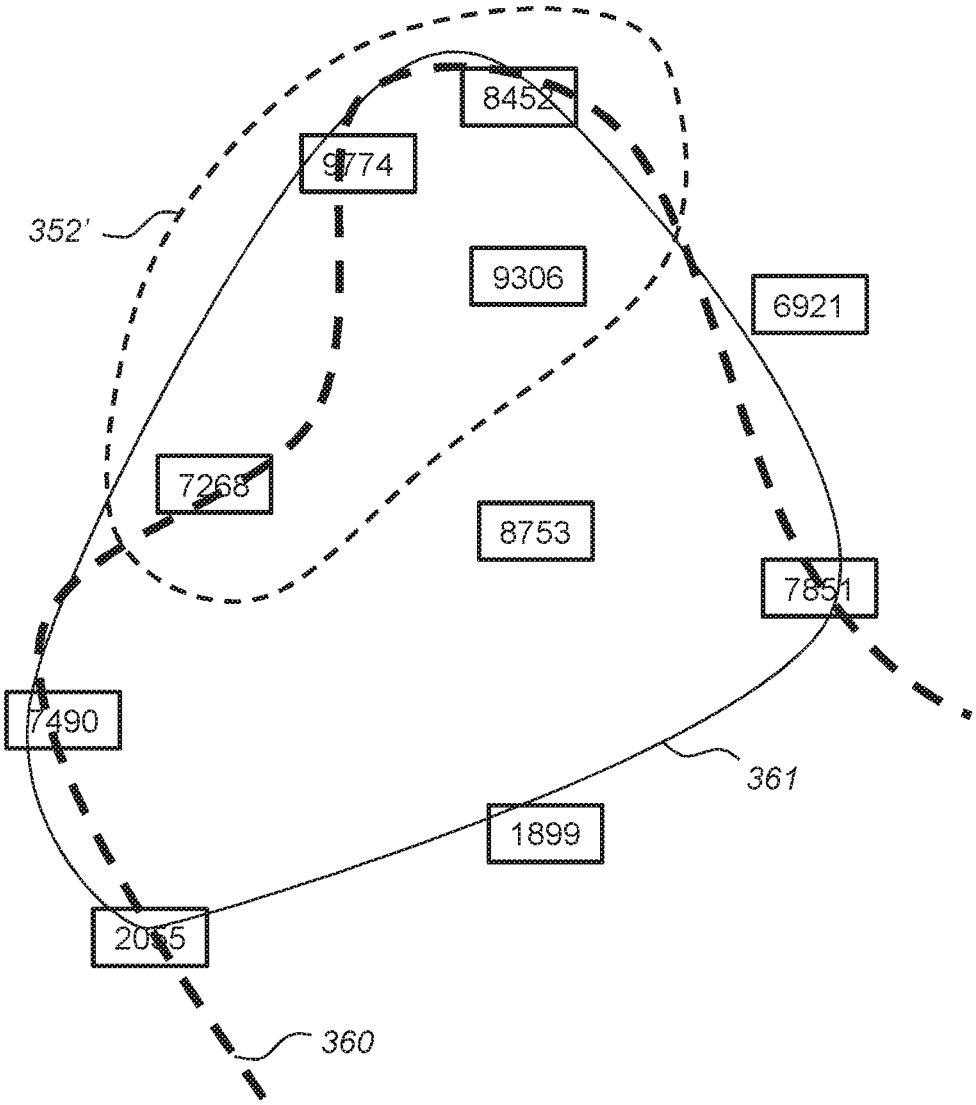
FIG. 5*b* shows a schematic representation of a geographic area according to an embodiment.

FIG. 5*b* shows a schematic representation of a geographic area according to an embodiment. In an example of an embodiment, the fault detection system is applied to an outdoor lighting system; for example a park. The mobile device travels through the park, as may be deduced from reported device identifiers and time stamps. For example, a user may use his mobile phone while he walks through the park. The mobile device receives, in order: 2055, 7490, 7268, 9744, 8452, 7851. Later, the fault detector receives these device identifiers. The fault detector may conclude that these lights were in working order. The fault detector does not receive the device identifiers: 9306, 6921, 8753 and 1899. Possibly, the fault detector will receive these device identifiers from some other mobile device though. If no mobile device reports one or more of these device identifiers either, the fault detector may conclude that the device identifiers correspond to a broken serviceable device.

In FIG. 5*b*, the set of a set of serviceable devices 352' correspond to the set of identifiers 352 of FIG. 4*b*. In this case, one of the device identifiers was missed. If a compression unit is used, the mobile device may simply report, set identifier 351, and serviceable device 9306.

In a more advanced embodiment, the fault detector 400 has access to a number of different sources of information about the serviceable devices. For example, the age of the serviceable devices: if the serviceable device nears the end of lifetime a broken device becomes more likely. Fault detector 400 may comprise a serviceable device age database to record the age of the serviceable devices. Fault detector 400 may receive health indicators. Fault detector 400 may receive device identifiers, from which fault detector 400 may obtain a delay 424; Longer delays imply a higher likelihood that the device is broken.

There is a need to integrate this information, to obtain a list of serviceable devices that are most likely broken, and therefore need checking and possibly servicing.

In an embodiment, the fault detection unit is arranged to assign a fault likelihood to serviceable devices in the first plurality. A fault likelihood may be a probability, or a so-called log-likelihood. A formal probability is not needed though. The fault likelihood may be an integer, say a 16 bit integer.

The fault detection unit may be arranged to assign an initial fault likelihood to serviceable devices in the first plurality. The initial fault likelihood may be the same for all devices. If arbitrary units are used, all devices may receive an initial likelihood of, say, 2^15, on a 16 bit range.

In an embodiment, the initial fault likelihood is representative of a fault based on the age of the device. For example, a statistical table may be used assign the initial fault likelihood based on the age.

Based on received information the likelihood assigned to a serviceable device may be increased or decreased. For example, the fault likelihood may be decreased in case a list is received comprising the device identifier of said serviceable device. For example, the fault likelihood may be increased in case no list is received comprising the device identifier of the serviceable device for some time. In an embodiment, a fault likelihood represents a fault probability estimate, which is updated, e.g., increased or decreased, using Bayes' rule as additional information regarding a serviceable device, e.g., device identifiers, health indicators, etc., is received.

In an embodiment, the fault likelihood is increased or decreased depending on a received health indicator. If the health indicator is within normal ranges, the fault likelihood is decreased; if the health indicator is outside normal ranges, the fault likelihood is increased.

For example, a fault likelihood may be increased by adding or subtracting a value. For example, a fault likelihood may be increased by multiplying with a value, higher or lower than 1.

Based on the likelihood serviceable devices may be selected. For example, faulty devices, including likely faulty devices, may be selected depending on the assigned fault likelihood of the faulty device. For example, each day a number of devices with the highest fault likelihood may be selected, say the 100 serviceable devices with the highest fault likelihood.

Additional information may be deduced from knowledge of the location of device identifiers. For example, one or more 'occupancy area'(s) may be defined. An occupancy area representing a geographic area in which the mobile device was located during reception of the device identifiers of the corresponding list. For example, in case of FIG. 5*b*, if device identifiers 7851, 7268, 8452, and 9774 are received by the fault detector from a mobile device, the fault detection unit may conclude that the mobile device has been located in rooms 504 and 503.

Occupancy areas may be constructed, as in the above example, from knowledge of the map, in this case, knowledge of the rooms in which devices are located. In this case, a visited room may be used an occupancy area. An occupancy area may also be constructed as the convex hull of all locations of serviceable devices that were reported within a time interval, say within an hour. The latter has been used in FIG. 5*b*. A path 360 has been constructed based on reported device identifiers and timestamps. Assuming all the device identifiers were visited within the time interval, the convex hull 361 may be constructed around all visited serviceable devices, say within a time period.

The fault detection unit may now increase the fault likelihood assigned to a serviceable device in the plurality, in case the serviceable device is located in the occupancy area but not in the corresponding list. For example, device identifiers 9306 and 8753 were not reported, e.g., were not in the uploaded list, however they do lie in an area which was visited by a mobile device. The fault detection unit cannot directly conclude that the corresponding serviceable devices are certainly faulty, as they may have been missed per chance. However, the likelihood that there may be something wrong with these devices increases.

The use of occupancy areas is well suited to areas in which serviceable devices are relatively close together and in which users stay a relatively long time, e.g., indoor locations, such as offices, etc.

As noted, an approximate path of the mobile device may be reconstructed from device identifiers and timestamps. In FIG. 5*b* this is path 360. This may be exploited to obtain further information regarding serviceable devices.

For example, in an embodiment, the fault detection unit may be arranged to, for a list received from a mobile device, determine a first device identifier on the list and a second identifier on the list, the time stamp corresponding to the second identifier being with a time threshold of the time stamp corresponding to the first identifier.

For example, in the illustration of FIG. 5*b*, the fault detection unit may determine that the first device identifier is 8452, and the second is 7851, and that the corresponding timestamps are close together, e.g., differ less than the time threshold.

The fault detection unit may further determine a third serviceable device of the first plurality, the identifier corresponding to the third serviceable device being absent from the list, the third serviceable device being located within a geographic threshold from the serviceable devices corresponding to the first and/or second device identifier.

For example, in the illustration of FIG. 5*b*, the fault detection unit may determine that the third device identifier is 6921, and that serviceable device 6921 is close to serviceable devices 8452 and 7851, e.g., within a geographic threshold, e.g., some distance.

The fault detection unit may now increase the fault likelihood assigned to the third serviceable device. For example, in the illustration of FIG. 5*b*, the fault detection unit may conclude that the mobile device travelled close to device 6921, and moreover, that the mobile device was likely in use that this time. Nevertheless, device identifier 6921 was not received. This points to a broken device more than an absent device identifier normally would do.

Typically, the serviceable devices, the mobile devices and the fault detector each comprise a microprocessor (not shown) which executes appropriate software stored at the serviceable device, mobile device and fault detector, e.g., serviceable device 201, mobile device 301 and fault detector 400; for example, that software may have been downloaded and/or stored in a corresponding memory, e.g., a volatile memory such as RAM or a non-volatile memory such as Flash (not shown). Alternatively, the serviceable device, mobile device and/or fault detector, e.g., may, in whole or in part, be implemented in programmable logic, e.g., as field-programmable gate array (FPGA); may, in whole or in part, be implemented as a so-called application-specific integrated circuit (ASIC), i.e. an integrated circuit (IC) customized for their particular use.

The serviceable device, mobile device and fault detector, may comprise one or more circuits arranged to perform the corresponding functions. The circuits may be a processor circuit and storage circuit, the processor circuit executing instructions represented electronically in the storage circuits. The circuits may also be, FPGA, ASIC or the like.

Figure 6A:
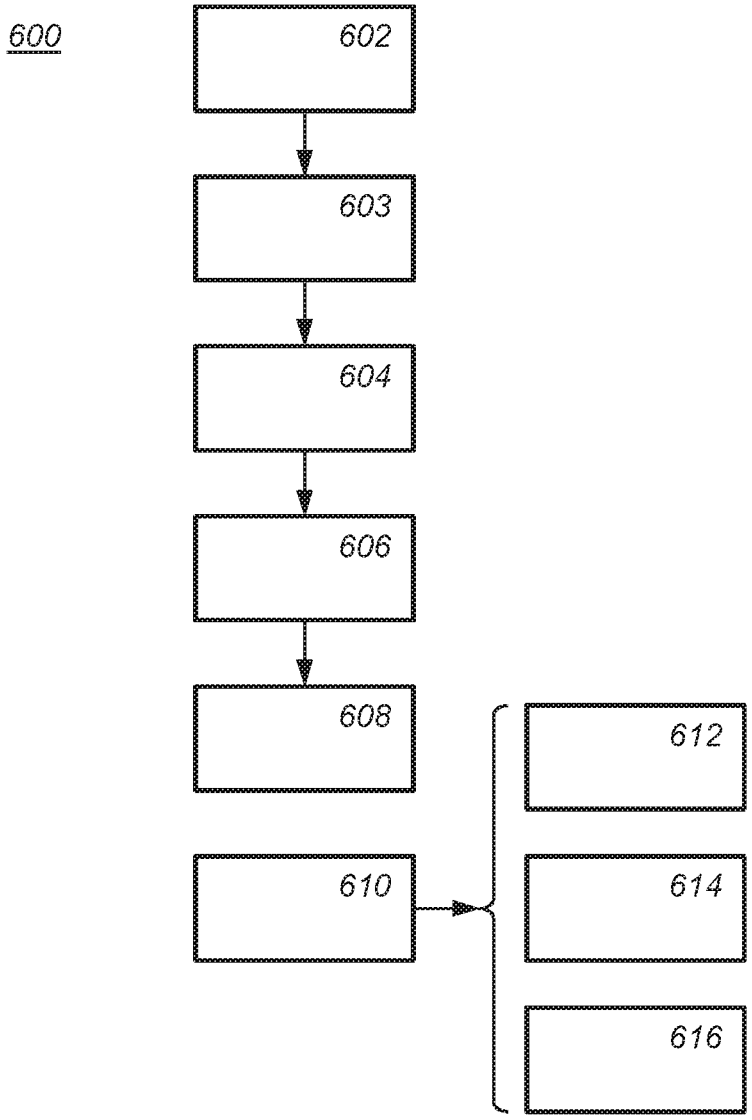
FIG. 6*a* shows a schematic flow chart of a fault detection method according to an embodiment.

FIG. 6*a* shows a schematic flow chart of a fault detection method 600 according to an embodiment. The fault detection method may be used for detecting faulty devices among a first plurality of serviceable devices. The first plurality of serviceable devices being distributed across a geographic area.

The method comprises:

Periodically transmitting 602 a wireless signal by serviceable devices in the first plurality, the wireless signal being receivable in a transmission range surrounding the serviceable device;

Encoding 603 information in the wireless signal, the information comprising at least a device identifier uniquely identifying the serviceable device within the first plurality of serviceable devices;

Receiving 604 the wireless signal of a serviceable device within the transmission range by a mobile device;

Obtaining 606 the device identifier from the wireless signal;

Adding 608 a device identifier received by the receiver to a list and storing the list of device identifiers received;

Detecting 610 faulty devices. Detecting 610 may comprise:

Storing 612 a plurality of device identifiers of the first plurality of serviceable devices;

Matching 614 received device identifiers with the database; and

Selecting 616 device identifiers in the plurality of device identifiers for which no device identifier was received in the time period.

Figure 6B:
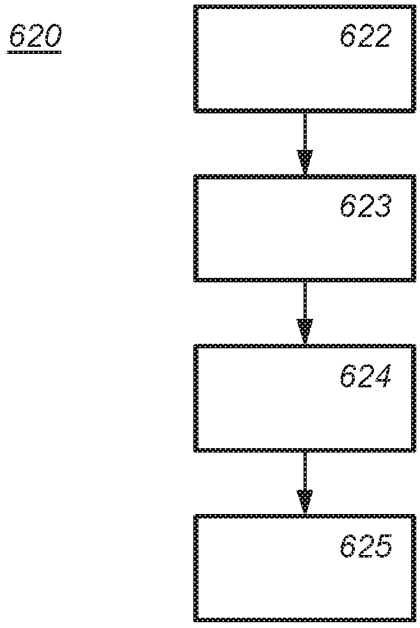
FIG. 6*b* shows a schematic flow chart of a method suitable for use with a fault detection method according to an embodiment.

FIG. 6*b* shows a schematic flow chart of a method 620 suitable for use with a fault detection method according to an embodiment. Method 620 may be executed by a mobile device, for example as part of a fault detection method, such as method 600. Method 620 comprises:

Receiving 622 a wireless signal of a serviceable device within the transmission range by a mobile device;

Obtaining 623 the device identifier from the wireless signal,

Adding 624 a device identifier received by the receiver to a list and storing the list of device identifiers received together with a timestamp, Sending 625 the list to a fault detector.

Many different ways of executing the methods are possible, as will be apparent to a person skilled in the art. For example, the order of the steps can be varied or some steps may be executed in parallel. Moreover, in between steps other method steps may be inserted. The inserted steps may represent refinements of the method such as described herein, or may be unrelated to the method. Moreover, a given step may not have finished completely before a next step is started.

A method according to an embodiment may be executed using software, which comprises instructions for causing a processor system to perform method 600 and/or 620. Software may only include those steps taken by a particular sub-entity of the system. The software may be stored in a suitable storage medium, such as a hard disk, a floppy, a memory etc. The software may be sent as a signal along a wire, or wireless, or using a data network, e.g., the Internet. The software may be made available for download and/or for remote usage on a server. A method may be executed using a bitstream arranged to configure programmable logic, e.g., a field-programmable gate array (FPGA), to perform the method.

It will be appreciated that the invention also extends to computer programs, particularly computer programs on or in a carrier, adapted for putting the invention into practice. The program may be in the form of source code, object code, a code intermediate source and object code such as partially compiled form, or in any other form suitable for use in the implementation of the method according to an embodiment. An embodiment relating to a computer program product comprises computer executable instructions corresponding to each of the processing steps of at least one of the methods set forth. These instructions may be subdivided into subroutines and/or be stored in one or more files that may be linked statically or dynamically. Another embodiment relating to a computer program product comprises computer executable instructions corresponding to each of the means of at least one of the systems and/or products set forth.

Figure 7A:
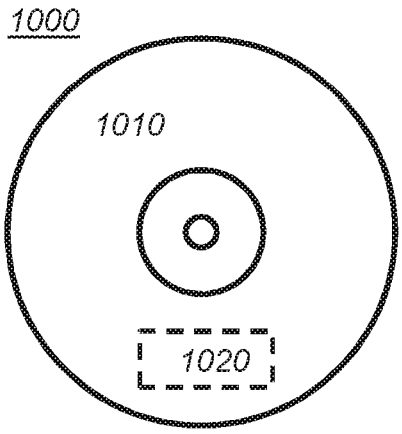
FIG. 7*a* shows a computer readable medium having a writable part comprising a computer program according to an embodiment.

FIG. 7*a* shows a computer readable medium 1000 having a writable part 1010 comprising a computer program 1020, the computer program 1020 comprising instructions for causing a processor system to perform a method, say method 600, 620 or parts thereof, according to an embodiment. The computer program 1020 may be embodied on the computer readable medium 1000 as physical marks or by means of magnetization of the computer readable medium 1000. However, any other suitable embodiment is conceivable as well. Furthermore, it will be appreciated that, although the computer readable medium 1000 is shown here as an optical disc, the computer readable medium 1000 may be any suitable computer readable medium, such as a hard disk, solid state memory, flash memory, etc., and may be non-recordable or recordable. The computer program 1020 comprises instructions for causing a processor system to perform said method of fault detection.

Figure 7B:
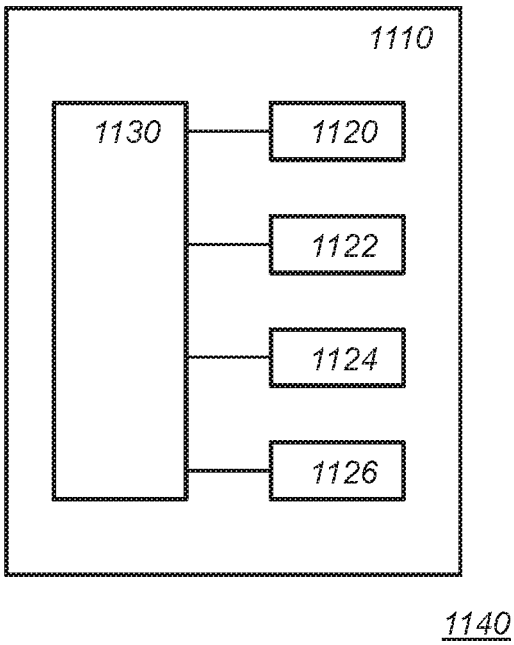
FIG. 7*b* shows a schematic representation of a processor system according to an embodiment.

FIG. 7*b* shows a schematic representation of a processor system 1100 according to an embodiment. The processor system comprises one or more integrated circuits 1110. The architecture of the one or more integrated circuits 1110 is schematically shown in FIG. 7*b*. Circuit 1110 comprises a processing unit 1120, e.g. a CPU, for running computer program components to execute a method according to an embodiment, say of fault detection or of receiving device identifiers, and/or implement its modules or units. Circuit 1110 comprises a memory 1122 for storing programming code, data, etc. Part of memory 1122 may be read-only. Circuit 1110 may comprise a communication element 1126, e.g., an antenna, connectors or both, and the like. Circuit 1110 may comprise a dedicated integrated circuit 1124 for performing part or all of the processing defined in the method. Processor 1120, memory 1122, dedicated IC 1124 and communication element 1126 may be connected to each other via an interconnect 1130, say a bus. The processor system 1110 may be arranged for contact and/or contact-less communication, using an antenna and/or connectors, respectively.

It should be noted that the above-mentioned embodiments illustrate rather than limit the invention, and that those skilled in the art will be able to design many alternative embodiments.

In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. A fault detection system for detecting faulty devices among a first plurality of serviceable devices, the first plurality of serviceable devices comprising a light source arranged for illuminating a surrounding area of the light source, the first plurality of serviceable devices being distributed across a geographic area, the system comprising:

the first plurality of serviceable devices, a serviceable device of the first plurality of serviceable devices comprising a wireless transmitter arranged to periodically transmit a wireless signal, the wireless signal being receivable in a transmission range surrounding the serviceable device, the wireless signal encoding information, the information comprising at least a device identifier corresponding to the serviceable device uniquely identifying the serviceable device within the first plurality of serviceable devices, the wireless signal being light emitted by the light source modulated by the wireless transmitter to encode the information, a plurality of mobile devices, a mobile device of the plurality of mobile devices comprising:

a receiver comprising a light sensor arranged to receive the wireless signal of a serviceable device within the transmission range, and to obtain the device identifier from the wireless signal, and a local storage unit for storing a list of received device identifiers, the receiver being arranged to add a device identifier received by the receiver to the list, a computer network sender arranged to send the list of device identifiers to a fault detector, and the fault detector arranged to detect faulty devices, the fault detector comprising:

a computer network receiver arranged to receive multiple lists from multiple mobile devices of the plurality of mobile devices, a database storing a plurality of device identifiers of the first plurality of serviceable devices, a fault detection unit arranged to select device identifiers in the plurality of device identifiers for which no device identifier was received in a time period, wherein the fault detection unit assigns a fault likelihood to serviceable devices in the first plurality by: assigning an initial fault likelihood to serviceable devices in the first plurality, decreasing the fault likelihood assigned to a serviceable device in case a list is received comprising the device identifier of the serviceable device, and selecting faulty devices in the first plurality depending on the assigned fault likelihood.

2. A fault detection system as in claim 1, wherein the light sensor is in the form of a camera arranged to receive said modulated light.

3. A fault detection system as in claim 1, wherein one or more mobile devices of the plurality of mobile devices comprise a scheduler arranged to delay sending the list of device identifiers to the fault detector, until a particular mode of computer network communication is available to a mobile device for sending the list, and/or a remaining battery power of the mobile device is larger than a minimum battery threshold.

4. A fault detection system as in claim 1, wherein the wireless transmitter of at least part of the serviceable devices of the first plurality of serviceable devices is arranged to include a health indicator in the information, the health indicator indicating the health of the serviceable device, the fault detection unit being arranged to detect faulty devices from received health indicators.

5. A fault detection system as in claim 4, wherein the serviceable devices of the part comprises:

a current measurement unit arranged to measure current flowing through the light source during operation, the health indicator depending on the measured current, and/or a voltage measurement unit arranged to measure voltage across the light source during operation, the health indicator depending on the measured voltage, and/or a power factor unit arranged to determine the power factor of the light source during operation, the health indicator depending on the power factor, and/or a temperature measurement unit arranged to measure the temperature of the light source during operation, the health indicator depending on the measured temperature.

6. A fault detection system as in claim 1, wherein one or more mobile devices of the plurality of mobile devices comprise an identifier store, the identifier store storing a set of device identifiers, the set of identifiers comprising identifiers of serviceable devices of the plurality in a subarea of the geographic area, one or more mobile devices in the plurality of mobile devices comprising a compression unit, the compression unit being arranged to determine if a number of device identifiers in the list of device identifiers which are not in the set of device identifiers is below a compression threshold, the computer network sender being arranged to send device identifiers in the list absent from the set, in case of a positive determination of the compression unit.

7. A fault detection system as in claim 1, wherein the receiver of mobile devices of the plurality of mobile devices is arranged with a sampling frequency, the sampling frequency indicating the frequency of sampling a wireless signal received at the receiver for a device identifier, the receiver being arranged to measure time elapsed since adding a new device identifier not yet on the list, and to reduce the sampling frequency if the time elapsed exceeds a threshold.

8. A fault detection system as in claim 1, wherein the fault detection unit is arranged to determine for a list received from a mobile device an occupancy area corresponding to the list, the occupancy area representing a geographic area in which the mobile device was located during reception of the device identifiers of the corresponding list, and increase the fault likelihood assigned to a serviceable device in the plurality, in case the serviceable device is located in the occupancy area but not in the corresponding list.

9. A fault detection system as in claim 1, wherein one or more mobile devices of the plurality of mobile devices are arranged to store device identifiers received by the receiver in the list together with a corresponding timestamp, the timestamp indicating the moment of reception of the identifier to which the timestamp corresponds, the computer network sender being arranged to send device identifiers together with the timestamp, the fault detection unit is arranged to, for a list received from a mobile device of the plurality of mobile devices, determine a first device identifier on the list and a second identifier on the list, the time stamp corresponding to the second identifier being with a time threshold of the time stamp corresponding to the first identifier, determine a third serviceable device of the first plurality, the identifier corresponding to the third serviceable device being absent from the list, the third serviceable device being located within a geographic threshold from the serviceable devices corresponding to the first and/or second device identifier, increasing the fault likelihood assigned to the third serviceable device.

10. A fault detection system according to claim 1, the mobile device comprising:

the wireless signal being light modulated to encode the information.

11. A fault detection method for detecting faulty devices among a first plurality of serviceable devices, the first plurality of serviceable devices being distributed across a geographic area, the method comprising:

periodically transmitting a wireless signal by serviceable devices in the first plurality, the wireless signal being receivable in a transmission range surrounding the serviceable device, the serviceable devices comprising a light source, the light source being arranged for illuminating a surrounding area of the light source, the wireless signal being light emitted by the light source modulated by the wireless transmitter to encode the information, encoding information in the wireless signal, the information comprising at least a device identifier uniquely identifying the serviceable device within the first plurality of serviceable devices, receiving by a light sensor the wireless signal of a serviceable device within the transmission range by a mobile device, obtaining the device identifier from the wireless signal, adding a device identifier received by the receiver to a list and storing the list of device identifiers received, detecting faulty devices, including:

storing a plurality of device identifiers of the first plurality of serviceable devices, selecting device identifiers in the plurality of device identifiers for which no device identifier was received in the time period, assigning a fault likelihood to serviceable devices in the first plurality by: assigning an initial fault likelihood to serviceable devices in the first plurality, decreasing the fault likelihood assigned to a serviceable device in case a list is received comprising the device identifier of the serviceable device, and selecting faulty devices in the first plurality depending on the assigned fault likelihood.

12. A method for use with a fault detection method as in claim 11, comprising:

receiving by the light sensor a wireless signal of a serviceable device within the transmission range by a mobile device, the wireless signal being light modulated to encode the information obtaining the device identifier from the wireless signal, adding a device identifier received by the receiver to a list and storing the list of device identifiers received together with a timestamp, sending the list to a fault detector.

13. A non-transitory computer-readable medium comprising a computer program product comprising one or more computer instructions arranged to perform all of the steps of claim 11, when the computer program product is run on one or more processors.

* * * * *